US010570633B2

(12) United States Patent
Bacon et al.

(10) Patent No.: US 10,570,633 B2
(45) Date of Patent: Feb. 25, 2020

(54) SYSTEM FOR LATERAL SUPPORT OF SHORING POSTS

(71) Applicant: Titan Formwork Systems LLC, Tempe, AZ (US)

(72) Inventors: David L. Bacon, Tempe, AZ (US); Michael Q. Hendricks, Rochester, MN (US)

(73) Assignee: Titan Formwork Systems LLC, Tempe, AZ (US)

( * ) Notice: Subject to any disclaimer, the term of this patent is extended or adjusted under 35 U.S.C. 154(b) by 0 days.

(21) Appl. No.: 15/815,104

(22) Filed: Nov. 16, 2017

(65) Prior Publication Data

US 2019/0145115 A1 May 16, 2019

(51) Int. Cl.

| | |
|---|---|
| ***E04G 25/08*** | (2006.01) |
| ***E04G 25/06*** | (2006.01) |
| ***E04G 5/16*** | (2006.01) |
| ***E04G 11/48*** | (2006.01) |
| *E04G 25/00* | (2006.01) |

(52) U.S. Cl.

CPC ..... *E04G 25/08* (2013.01); *E04G 5/16* (2013.01); *E04G 11/483* (2013.01); *E04G 25/061* (2013.01); *E04G 2025/006* (2013.01)

(58) Field of Classification Search

CPC .. E04G 7/307; E04G 7/34; E04G 5/16; E04G 11/483; E04G 25/08; Y10T 403/30; Y10T 403/53

See application file for complete search history.

(56) References Cited

U.S. PATENT DOCUMENTS

| | | | | |
|---|---|---|---|---|
| 5,040,916 A * | 8/1991 | Morgan | E04G 7/26 | 403/387 |
| 5,427,465 A * | 6/1995 | Sato | E04G 7/16 | 403/385 |
| 5,713,687 A * | 2/1998 | Schworer | E04G 7/304 | 403/49 |
| 6,305,868 B1 * | 10/2001 | Kinoshita | E04G 7/305 | 403/196 |

(Continued)

FOREIGN PATENT DOCUMENTS

| | | | |
|---|---|---|---|
| DE | 20005629 U1 * | 6/2000 | E04G 5/16 |
| EP | 2808464 A1 * | 12/2014 | E04G 5/14 |
| WO | WO-2006108495 A1 * | 10/2006 | E04G 11/483 |

OTHER PUBLICATIONS

Titan HV Equipping Builders to Succeed, Titan Formwork Systems, dated 2017, 12 pp.

*Primary Examiner* — Joshua T Kennedy
(74) *Attorney, Agent, or Firm* — Brinks Gilson & Lione

(57) ABSTRACT

A system for laterally supporting a vertical shoring post is provided. The system includes a head and a jaw assembly, the jaw assembly movably mounted to the head, the head configured for selective engagement with a shoring post, and the jaw assembly configured for engagement with a beam that provides lateral support to the shoring post. The head comprises first and second arms that extend in the same general direction and when engaging the shoring post the first and second arms are disposed upon opposite sides of the shoring post. The jaw assembly includes a fixed jaw and a movable jaw, the moving member pivotably connected to the fixed jaw, wherein the fixed jaw and movable jaws are configured to receive an end of the beam therebetween.

15 Claims, 11 Drawing Sheets

(56) References Cited

U.S. PATENT DOCUMENTS

| | | | | |
|---|---|---|---|---|
| 7,588,537 | B2 * | 9/2009 | Bass | A61B 17/02 600/210 |
| 10,119,279 | B2 * | 11/2018 | Brinkmann | E04G 1/12 |
| 2002/0014371 | A1 * | 2/2002 | Krause | E04G 5/16 182/186.8 |
| 2002/0106237 | A1 * | 8/2002 | Rogers | E04G 7/14 403/49 |
| 2012/0042495 | A1 | 2/2012 | Bacon | |
| 2012/0042600 | A1 | 2/2012 | Bacon | |
| 2014/0270920 | A1 | 9/2014 | Bacon | |

* cited by examiner

SYSTEM FOR LATERAL SUPPORT OF SHORING POSTS

BACKGROUND

This disclosure relates to engineered shoring post systems where cross-bracing is assembled to vertical shoring posts to carry horizontal loads developed in the load being carried, as well as to provide lateral support for a plurality of vertical shoring posts. Often a shoring plan calls for a single beam to span and be fixed to several adjacent vertical shoring posts. The cross bracing may be called for attachment to at least one shoring post at a height that necessitates a ladder being used by the crew that is installing the shoring system.

BRIEF SUMMARY

A first representative embodiment of the disclosure is provided. The embodiment includes a system for laterally supporting a vertical shoring post. The system includes a head and a jaw assembly, the jaw assembly movably mounted to the head, the head configured for selective engagement with a shoring post, and the jaw assembly configured for engagement with a beam that provides lateral support to the shoring post. The head comprises first and second arms that extend in the same general direction and when engaging the shoring post the first and second arms are disposed upon opposite sides of the shoring post. The jaw assembly includes a fixed jaw and a movable jaw, the moving member pivotably connected to the fixed jaw, wherein the fixed jaw and movable jaws are configured to receive an end of the beam therebetween.

A second representative embodiment of the disclosure is provided. The embodiment includes a system for shoring. The system includes first and second shoring posts configured to be disposed vertically to vertically support a load, the first and second shoring posts configured to be disposed adjacent to each other with a space therebetween. A head and jaw assembly are provided. The head is configured to engage a portion of the first shoring post and engage a portion of the second shoring post to provide lateral support to the first and second shoring posts. The jaw assembly includes a fixed jaw and a movable jaw that is pivotably connected to the fixed jaw with a pinned connection, wherein the jaw assembly is configured to retain an end of a beam therebetween. The head includes opposed first and second arms, each of the first and second arms have extended ends, wherein space is defined between the first and second arms, wherein the head is configured to engage the first shoring post such that the shoring post extends within the space. When the shoring post extends within the space between the first and second arms and contacts one or both of the first and second arms, a centerline of the beam extends through the first shoring post. Wherein the beam extending from the jaw assembly extends an outer surface of the second shoring post, wherein a line through the center of the beam at an end portion within the jaws assembly extends through the shoring post.

A third representative embodiment of the disclosure is provided. The embodiment includes a method of installing a plurality of shoring posts. The method includes the steps of installing first and second vertical shoring posts to a desired height for shoring load above the respective first and second shoring posts; inserting an end of a beam into a jaw assembly, the jaw assembly comprising a fixed jaw and a movable jaw that is pivotably attached to the fixed jaw, wherein the fixed and movable jaws are configured to accept the end of the beam therebetween and the movable jaw is biased toward engagement with the end of the beam, the jaw assembly pivotably mounted to a head; manipulating the beam such that the head substantially horizontally approaches a portion of the first vertical shoring post to dispose the vertical shoring post into a space between first and second arms that define the head; and fixing the beam with respect to the second shoring post.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

BRIEF DESCRIPTION OF THE DRAWINGS

FIG. 1 is a perspective view of a shoring post system with two cross-beams spanning multiple vertical shoring posts to provide for lateral stability to the vertical shoring posts, with a connection device to connect an end of each beam to a vertical shoring post at a relatively high location upon the vertical shoring post.

DETAILED DESCRIPTION OF THE DRAWINGS AND THE PRESENTLY PREFERRED EMBODIMENTS

Figure 7:
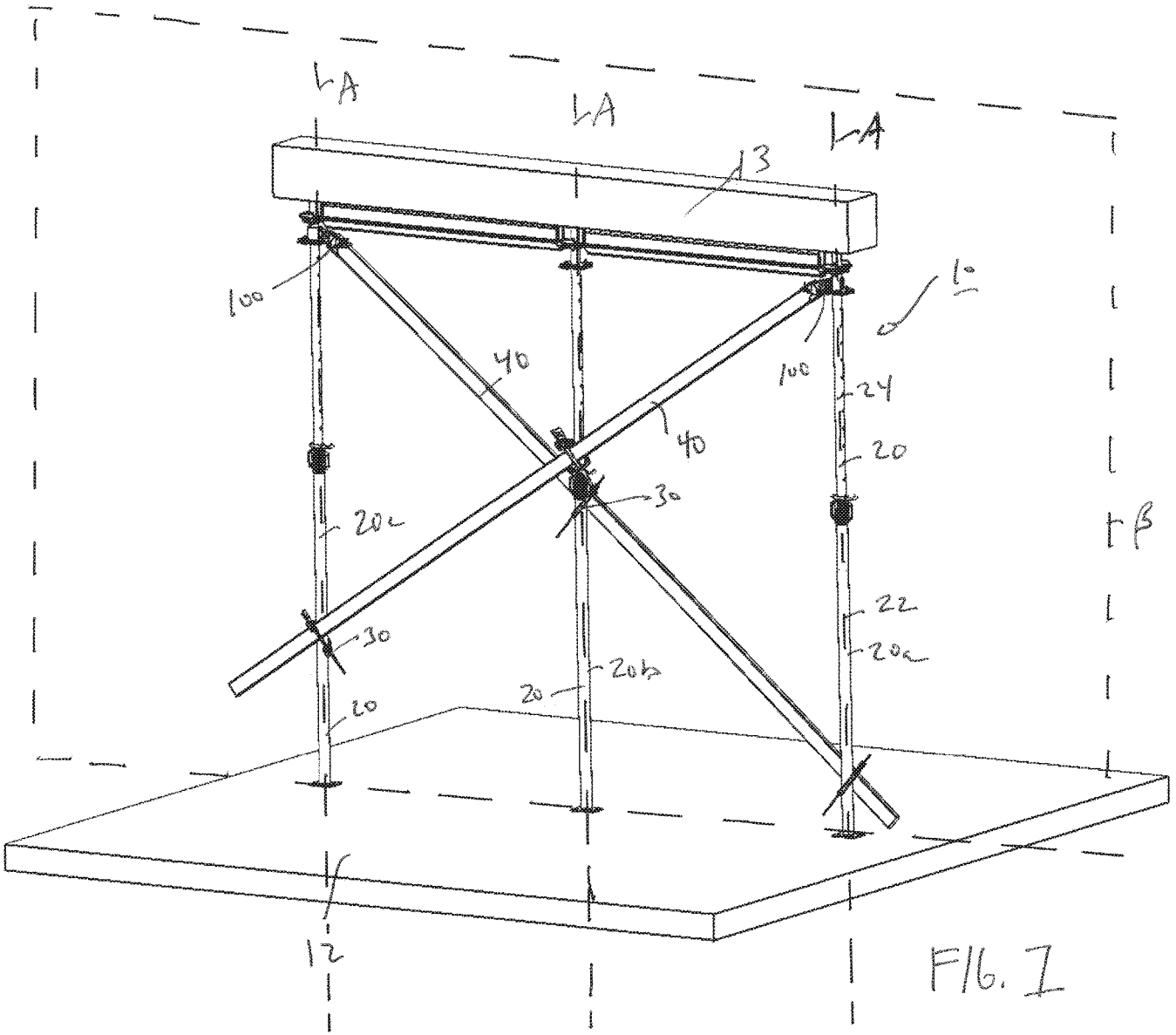
FIG. 7 is perspective view of the jaws assembly in the open position with the beam removed, i.e. with the jaws assembly in the orientation taken when an end of a beam is inserted within the jaws assembly.
Figure 2:
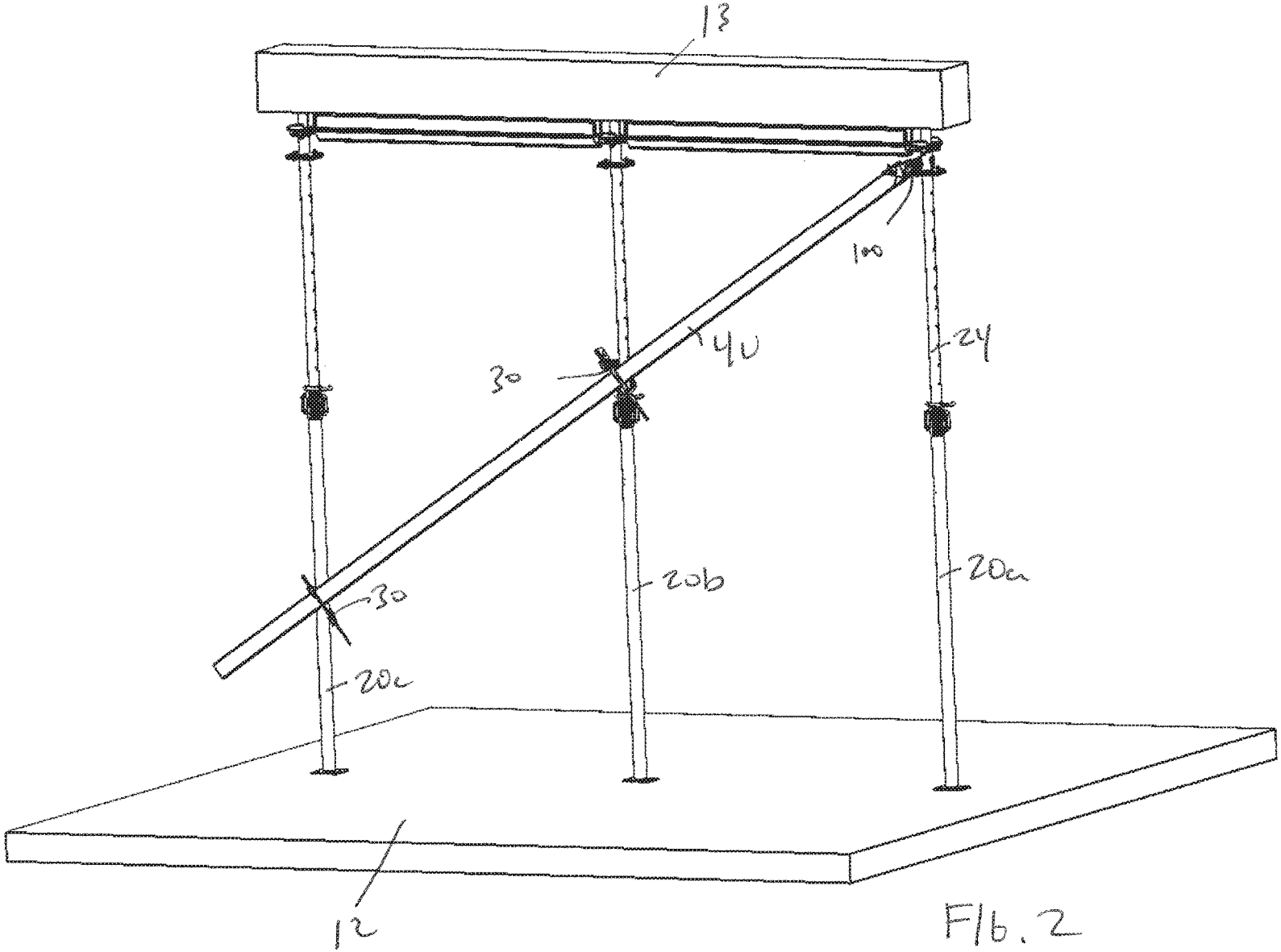
FIG. 2 is the view of FIG. 1 showing only a single cross beam spanning the multiple vertical shoring posts.

Turning now to FIGS. 1-11 a system 10 for shoring a vertical load is provided. The system includes a plurality of shoring posts 20 that are disposed as desired to shore, i.e. provide vertical support from under a load for an extended period of time, and be removable when the need to provide the vertical shoring support no longer exists. In some embodiments, the shoring posts 20 may be disposed along a line such that a centerline A through two or more aligned shoring posts 20 may extend through a single vertical plane B, and as depicted schematically in FIG. 1. In other embodiments, three or more shoring posts may be aligned generally along the same plane, such as where a portion of the cross-section of each of the plurality of shoring posts extends through a single vertical plane. In still other embodiments, multiple shoring posts 20 may be aligned such that they are generally aligned along the same plane, such as where the cross-sections of each shoring posts lies within from 6 inches to a foot from the same vertical plane.

The system 10 is provided to allow for cross-members or beams 40 to be rigidly connected to two or more adjacent shoring posts 20 to provide for lateral stability between adjacent shoring posts, and such that the cross-members or beams are disposed to carry a portion of the vertical load disposed upon the shoring posts 20. Cross-members or beams 40 are often called for in an engineered shoring plan to account for horizontal loads and also to provide rigidity to a shoring system as needed due to changing environmental factors (wind, the weight of workers and construction equipment being carried by the shoring system and the like) that may affect the shoring system. Cross-members or beams 40 are typically disposed between and rigidly connected to multiple adjacent shoring posts 20, with temporary clamps, such as wedge clamps (e.g. 40, FIGS. 1 and 2) and are normally assembled to multiple adjacent shoring posts 20 after the shoring posts are positioned. Often an engineered shoring plan will call for a single beam 40 to cross between two, three, or more shoring posts, and may be disposed diagonally or often from a top portion (24) of a first shoring post 20*a* (FIG. 1) to a mid-portion of an adjacent shoring post 20*b* (FIG. 1) and often to a lower portion of a third shoring post (20*c* in FIG. 1).

Often when beams 40 are installed between multiple vertical shoring posts, the beam 40 is connected to a first post at a height that is above 7-8 feet, which typically requires the assembly team that is setting up the engineered shoring system to use a ladder or scissor lift to attach the beam to the first post, often at a height of 7-20 feet above the surface that the first shoring post rests upon.

The system 10 includes a connection device 100 that allows for a beam to be rigidly mounted to a shoring post 20 (e.g. shoring post 20*a* of FIG. 1) at a relatively high location without requiring the operator to climb a ladder to connect the beam 40 to the shoring post 20. The system includes a head 120 and a jaws assembly 140 that is pivotably connected to the head 120. A first end portion 42 of the beam 40 is received within the jaws assembly 140 to fix the first end portion 42 of the beam thereto such that the user can manipulate a remote portion 44 of the beam to guide the head 120 to engage the appropriate portion of the shoring post 20.

The head 120 includes first and second arms 122, 124 that are spaced from each other to establish a void 129 therebetween. The void is configured to allow for the shoring post 20 to be received within the void 129, such that the first and second arms are disposed on opposite sides of the shoring post 20. The first and second arms 122, 124 may each have an extended end portion 122*a*, 124*a* and a connected end portion 122*b*, 124*b*. The connected end portions 122*b*, 124*b* may be directly connected to each other, or in some embodiments, the connected end portions 122*b*, 124*b* may be connected to opposite ends of a central portion 126.

Figure 6:
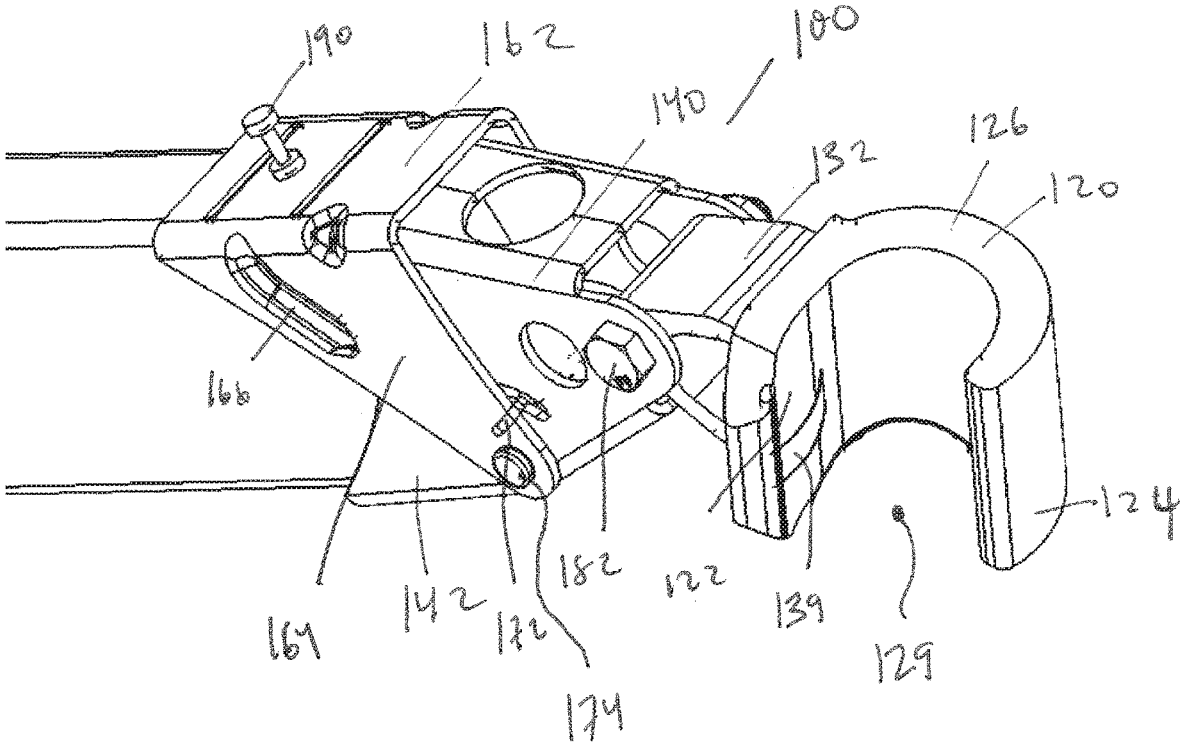
FIG. 6 is a perspective view of the connection device with a beam retained by the jaws assembly.
Figure 7:
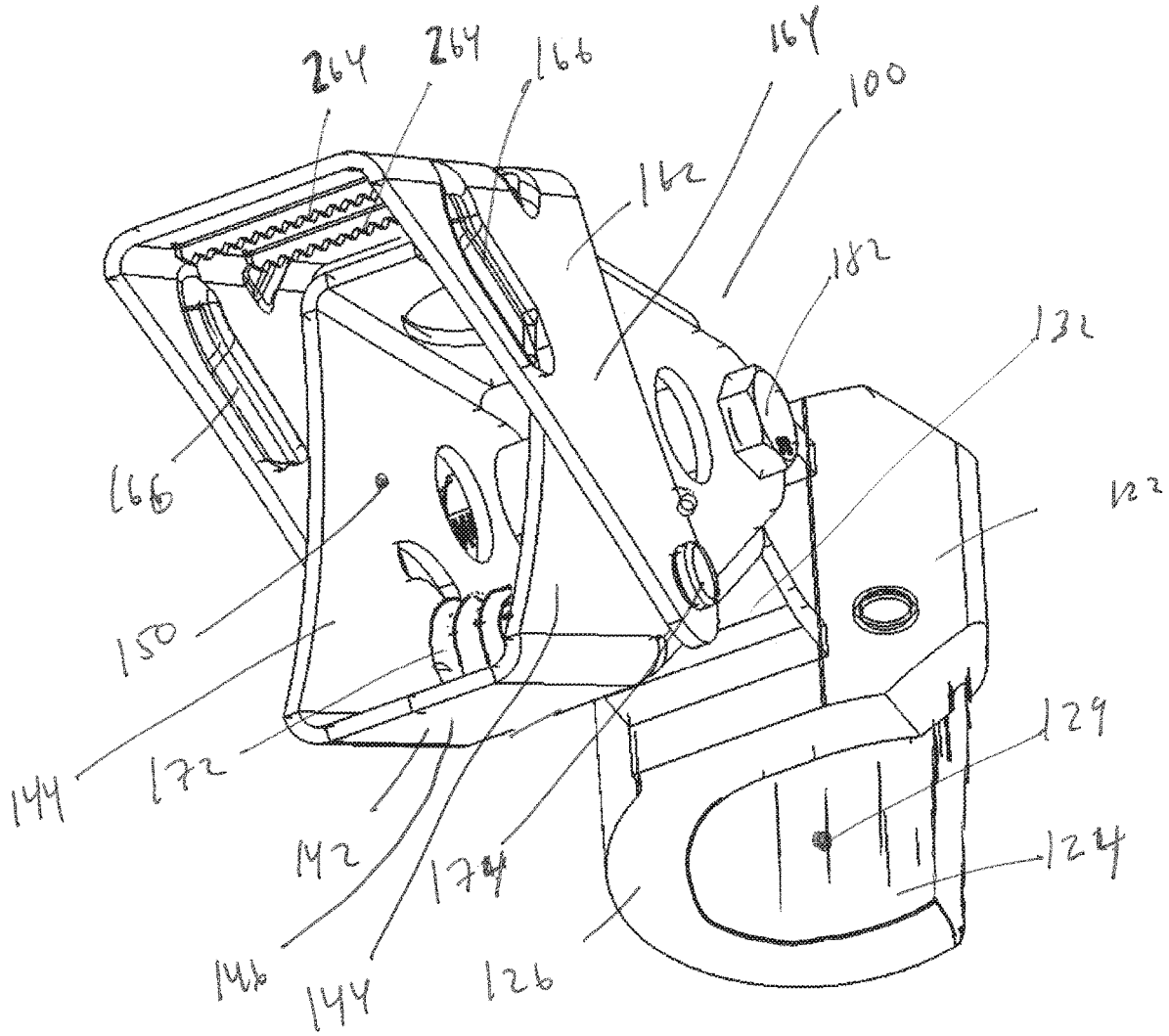
Figure 8:
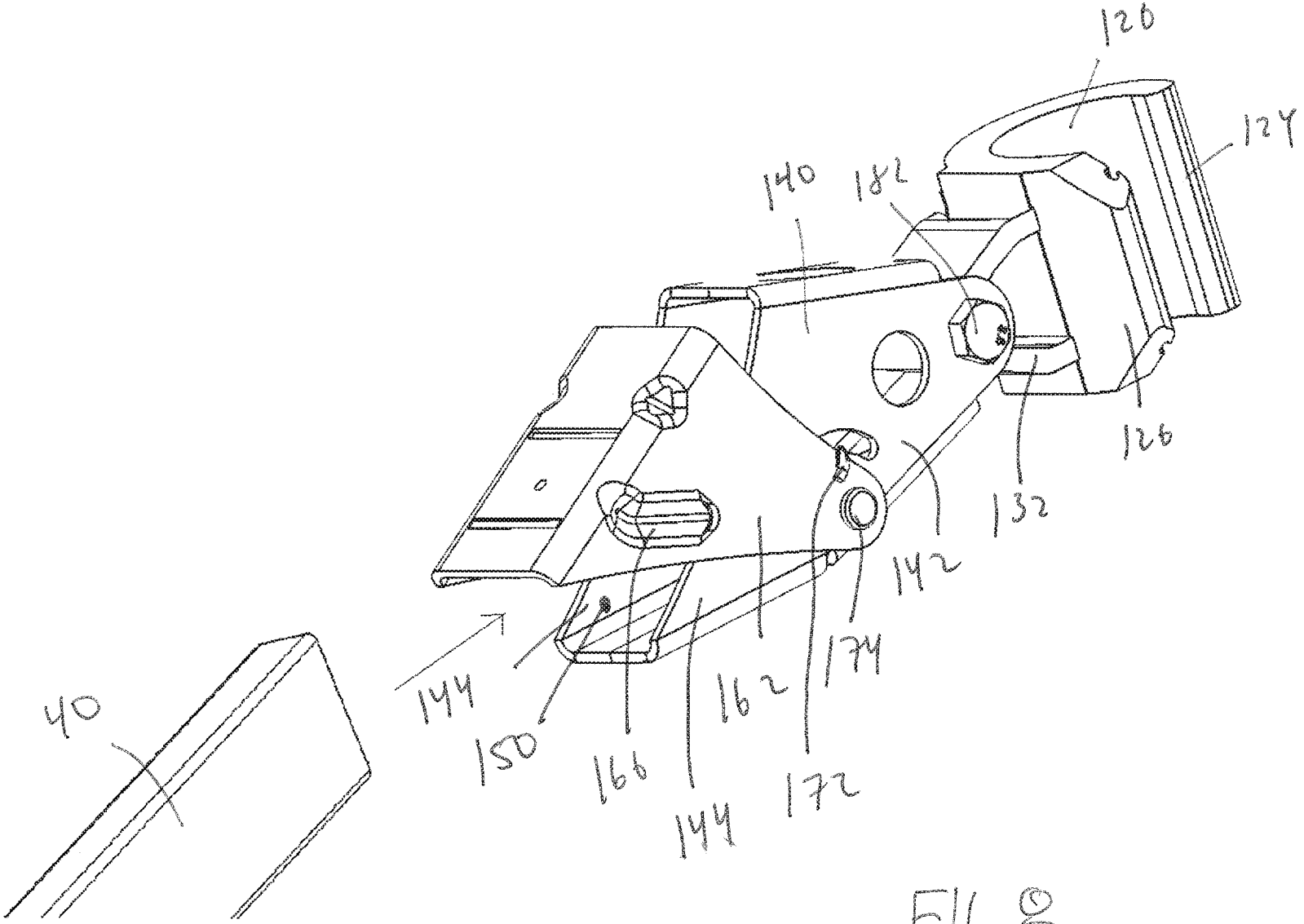
FIG. 8 is a perspective view of the jaws assembly in the biased closed position with a beam approaching the jaws assembly.

In some embodiments, the first and second arms 122, 124 are rigid and are rigidly mounted with respect to each other. In some embodiments, the first and second arms 122, 124 may be mirror images of each other across a mirror plane that extends between the first and second arms 122, 124, while in other embodiments, the extended end portions 122*a*, 124*a* of the first and second arms 122, 124 may have different geometries and may extend a different distance, such as shown in FIG. 6, where the first arm 122 is longer than the second arm 124.

In some embodiments, the first and second arms 122, 124 are formed as a single monolithic member, with the arms directly extending from each other or in other embodiments extending from opposite ends of a central member 126, which is formed from the single monolithic member with the first and second arms 122, 124. In other embodiments, the arms (and central portion when provided) may be formed from multiple different components that are rigidly fixed together.

In other embodiments, the first and second arms 122, 124 may be movably mounted to each other, such as pivotable with respect to each other (or such as to a central portion). In this embodiment, the arms 122, 124 may be biased toward each other (specifically biased such that the extended ends 122*a*, 124*a* are urged toward each other), which can be overcome to urge the extended ends 122*a*, 124*a* away from each other with the shoring post 20 slid into the void 129 between the arms. In some embodiments, one or both of the extended ends 122*a*, 124*a* may have cam surfaces that contact the shoring post as the head is moved toward the shoring post, and the contact upon the cam surfaces urge the extended ends 122*a*, 124*a* of the arms away from each other to allow the post to slide into the void 129. This embodiment may be useful to provide an initial connection between the head 120 and the shoring post 20 before the beam 40 is fixed to neighboring posts, which urges contact between the head 120 and the post, as discussed below.

Figure 3:
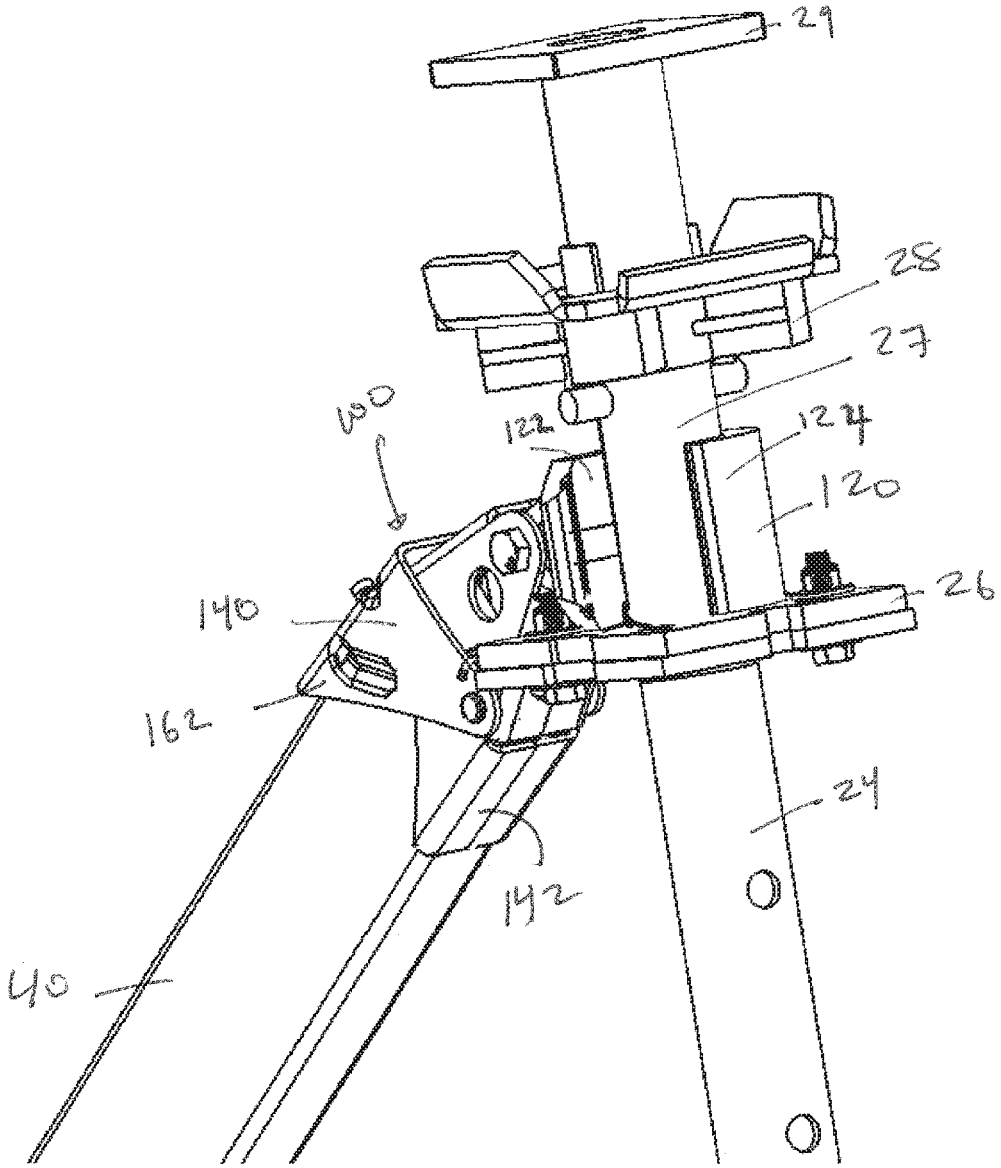
FIG. 3 is a perspective view of a head of the connection device of FIG. 1 engaging a shoring post.
Figure 4:
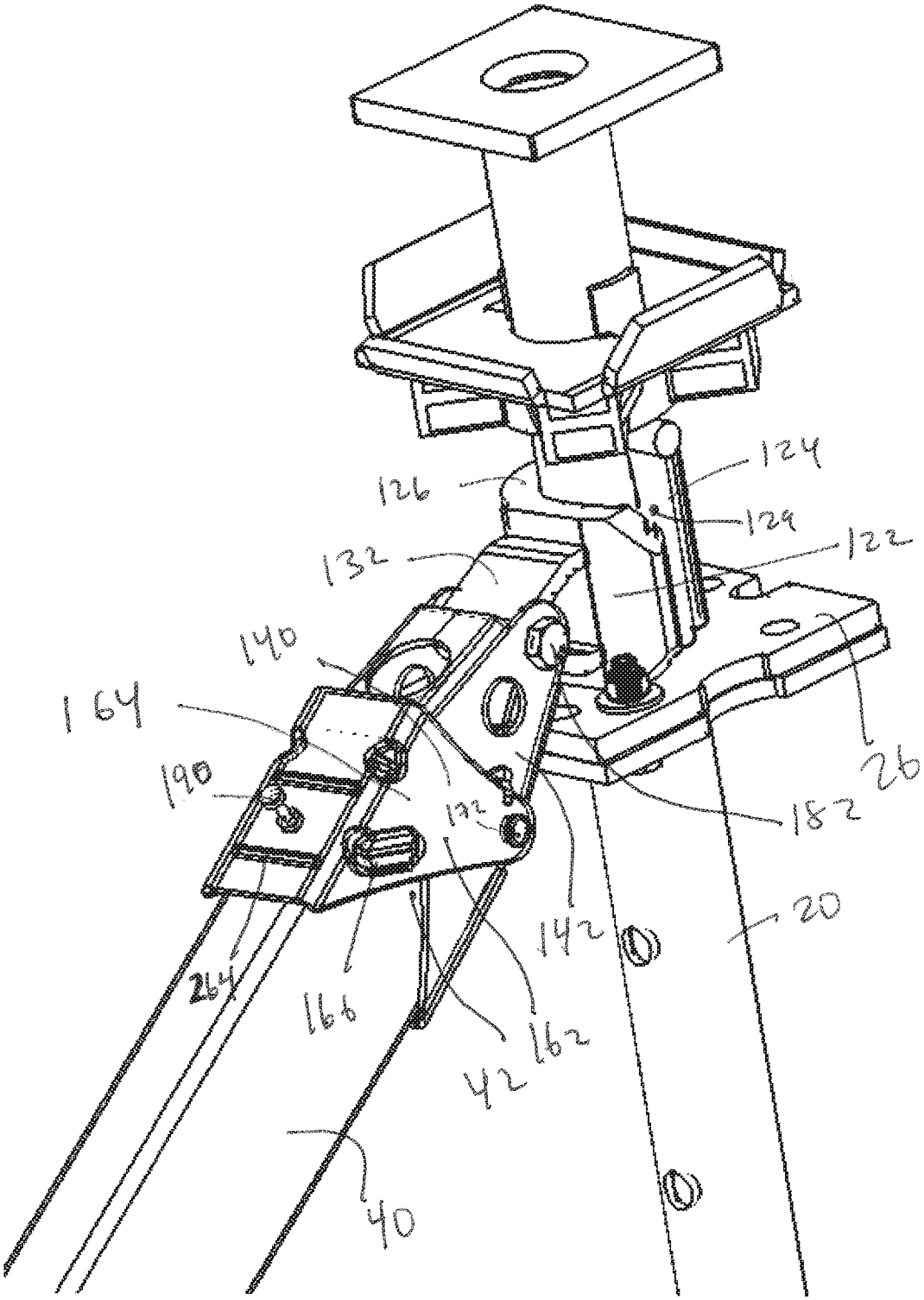
FIG. 4 is another perspective view of a head of the connection device of FIG. 1 engaging a shoring post with a beam extending from a jaws assembly.

The first and second arms 122, 124 may be formed to receive a section of the shoring post 20, such as a shoring post extension 27, i.e. a section of a shoring post 20 that extends above the midplate and below the drop head nut 28, as depicted in FIG. 3. In other embodiments, the first and second arms 122, 124 can be configured to receive other portions of a shoring post within the void, as well as shoring posts with various geometries such as round, square, oblong, and the like.

When installed, the head 120 may rest upon a horizontal surface or portion of the shoring post due to gravity, such as upon the bottom plate 26 of the head of the shoring post. When the beam 40 is fixed to the shoring post by way of the head 120 the forces extending between the shoring post 20 and the beam may be compressive or in tension, and these static loads are transferred between the shoring post 20 and the beam by way of the head 120.

The first and second arms 122, 124 may be configured such that the void 129 is shaped in the same manner and only a slightly larger cross-section than the cross-section of the portion of the shoring post 20 that will be disposed within the void 129. For example, where the shoring post 20 is circular, the inner surfaces of the first and second arms 122, 124 both have an arcuate geometry that closely matches the diameter of the shoring post 20. In embodiments where the head 120 further includes a central portion between the first and second arms 122, 124, the geometry of the collective inner surfaces of the first and second arms 122, 124 and the central portion 126 may be arcuate to match the diameter of the shoring post. In some embodiments the inner surface of the head 120 may have a geometry such that the head contacts a half of the circumference of the shoring post disposed therein, or in other embodiments, the inner surface of the head 120 may contact just slightly less than half of the circumference of the shoring post, such as about 160 to 179 degrees of circumference.

In embodiments where the head 120 connects with square or rectangular segments of shoring posts, the first and second arms 122, 124 may have a geometry that matches the geometry of the shoring post, such that the inner surface of the head (i.e. the arms and the central portion when provided) make surface to surface contact with all or a portion of three sides of the shoring post.

The extended ends 122*a*, 124*a* of the first and second arms 122, 124 establish an opening into the void 129 to allow the shoring post 20 to slide into and out of the void 129 as needed to install the head 120 onto the shoring post or remove the head 120 from the shoring post 20. The opening is dimensioned to be larger than the diameter of largest segment of the shoring post 20 that could be disposed within the void 129 (and for telescoping shoring posts, the segment of the shoring post with the largest diameter). In some embodiments, the opening is dimensioned to be larger than any portion of a shore or the drophead of a shore that could be intended to receive a cross-member. In embodiments where the head 120 may connect to square, rectangular, or oblong shoring posts, the opening into the void is larger than the largest horizontal projection of the shoring post 20 that would need to extend into the void 129 based upon the necessary orientation of the head 120 (and the jaws mechanism 140 and beam 40) with respect to the shoring post 20. For example, in embodiments where the shoring post is square, the opening should be at least just larger than the width of each face of the square post, such that the post can slide into and out of the void 129 easily.

In some embodiments, one or both of the first and second arms 122, 124 may include a retention spring 139 that assists with proper alignment of the shoring post 20 within the void, and urges the shoring post 20 to contact the inner surfaces of the first and second arms 122, 124 and the central portion 126 when provided. The retention spring 139 may be a leaf spring that extends outward from the respective arm and has an extended position that narrows the opening into the void to a distance that is less than the diameter of a cylindrical shoring post, or less than the largest horizontal projection of the shoring post. The spring 139 is initially compressed as the head 120 is directed toward the shoring post 20 and passes between the distal end portions 122*a*, 124*a* of the arms. The shoring post 20 eventually passes the spring 139 to allow the spring to return to the expanded portion. The spring 139 provides some resistance to the head 120 moving away from the shoring post 20, which assists with maintaining the head 120 aligned with the shoring post as the beam 40 is manipulated to be fixed to the adjacent shoring posts, which as discussed below fixes the head 120 onto the shoring post due to the horizontal force of the beam 40 being applied to the shoring post 20 through the head 120.

Figure 9:
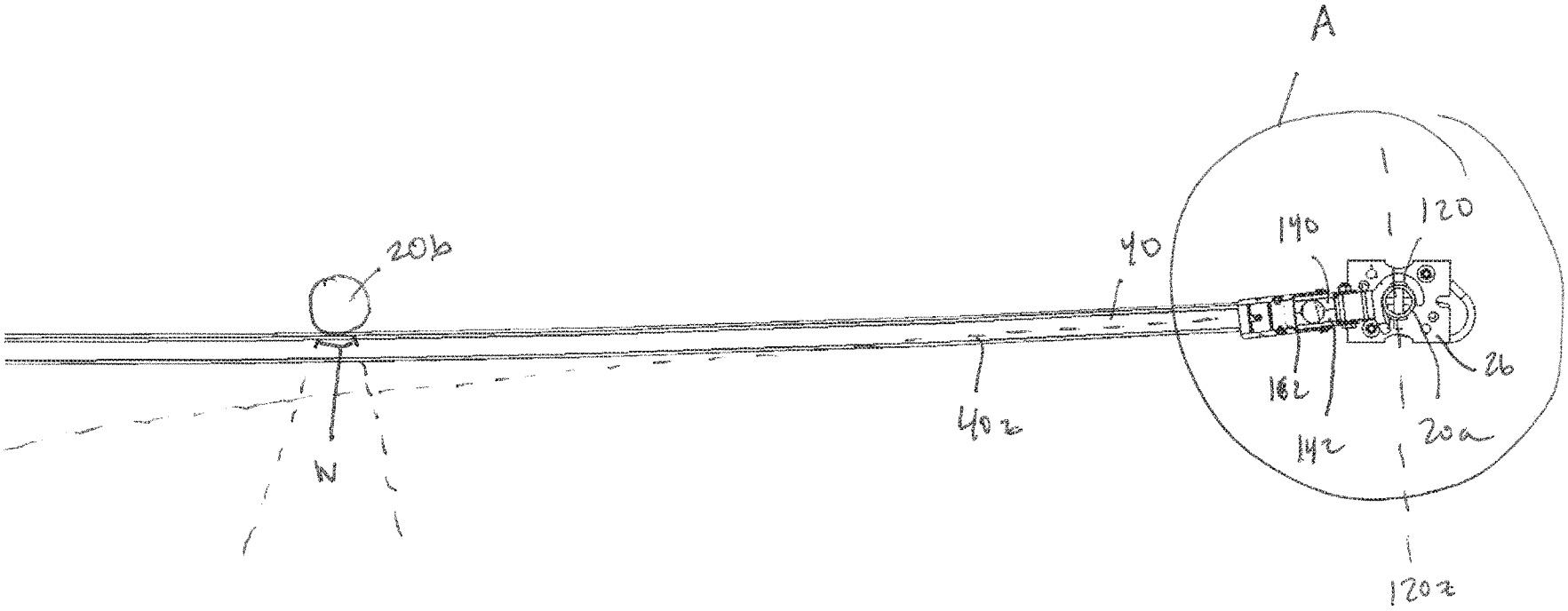
FIG. 9 is a top view of FIG. 2, with a portion of the second shoring post and the clamp between the beam and the second shoring post removed to depict the engagement between the beam and the second shoring post.
Figure 10:
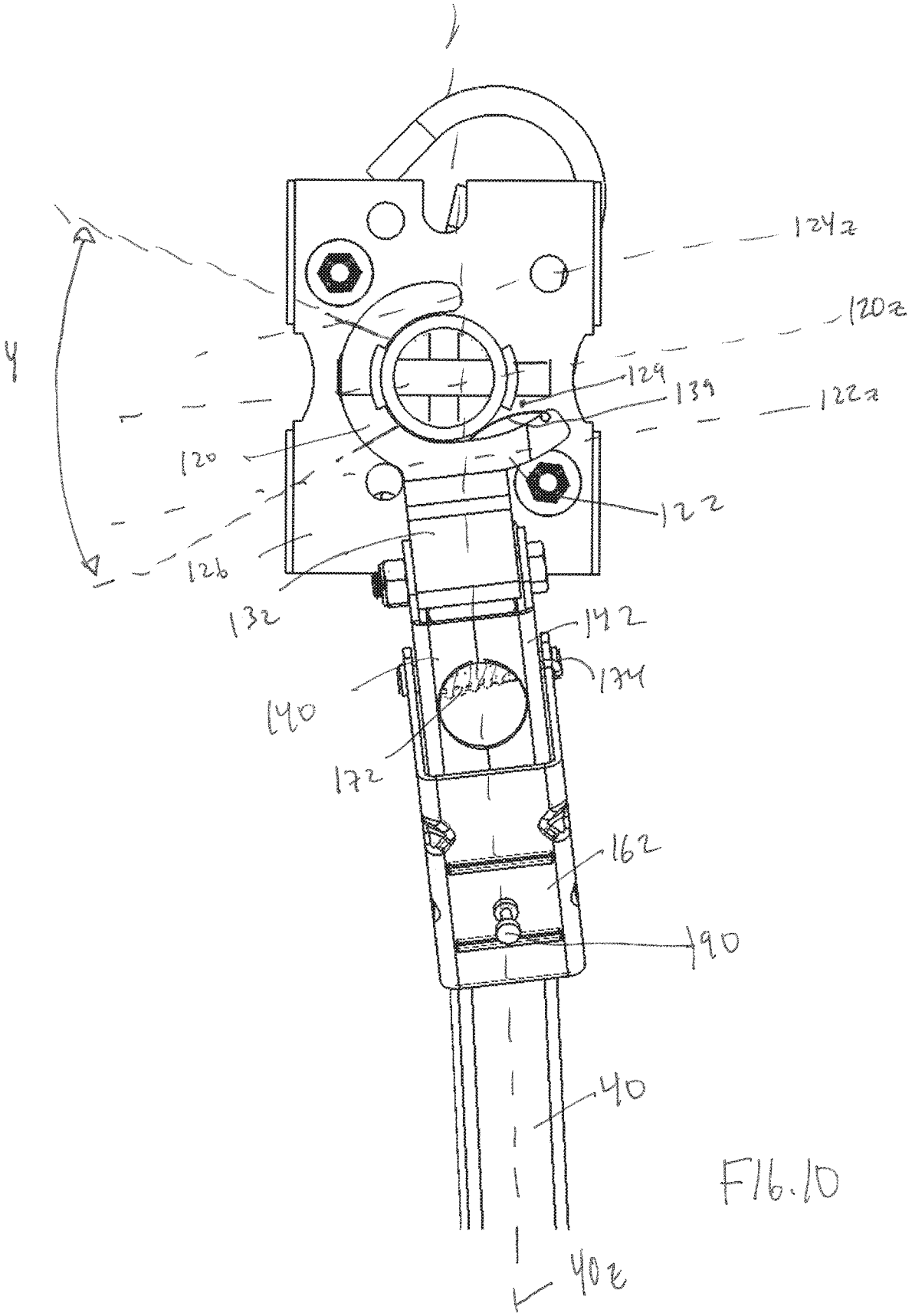
FIG. 10 is a view of detail A of FIG. 9.

When the shoring post 20 is disposed within the void 129 and the inner surface of the head 120 contacts the shoring post, the forces may be transferred between the head 120 and the shoring post 20 along a line (schematically shown as 120*z* in FIG. 10). Alternatively, where the shoring post 20 makes surface to surface contact with a larger surface of the head 120, the force may be transferred along a range of the portion of contact, shown schematically as range Y (FIG. 10). As discussed below, because the beam 40 extends to a second adjacent shoring post 20*b* (FIG. 1) the head 120 may be biased into contact with the shoring post either along the line 120*z*, or along the range W. The beam 40 would run past an outer surface of the second shoring post 20*b* that faces in a substantially opposite direction (range of contact W, FIG. 9) as the first shoring post 20*a* receives force from the head 120.

The head 120 may include a flange 132 or other structures that extends therefrom that provides a structure that provide a connection with the jaws mechanism 140. In some embodiments, the flange 132 may extend horizontally from the head 120 in a direction that is perpendicular, or substantially perpendicular to an axis 122*z* through the first arm 122. The term "substantially" when used herein is defined to mean within a range of 5-10% plus or minus of the dimension or angle that is referenced therewith. In this embodiment, the alignment of the head 120 and the flange 132 controls the alignment of the beam 40 (as fixed to the jaw assembly 140) and the shoring post 20. In some embodiments, the flange 132 has an aperture that can receive a pin 182 that rotatably connects the head 120 to the jaws mechanism. In some embodiments, the pin 182 extends through an axis that is perpendicular to a longitudinal axis through the shoring post, such that the jaw mechanism 140 can pivot upward and downward with respect to the head 120.

The jaw assembly 140 is best depicted in FIGS. 4-8 and includes a fixed jaw 142 and a movable jaw 162, with the movable and fixed jaws 162, 142 being pivotably connected with a pin 174. The movable jaw 162 is called "movable" because the fixed jaw 142 is pivotably fixed to the head 120 with the pin 182, and therefore the movable jaw 162 pivots with respect to the fixed jaw 142. The fixed jaw may be formed with two opposite side walls 144 that are spaced from each other a distance that is just larger than a width of the beam 40 to be received therein. For example, in some embodiments, conventional 2×4 lumber (of an appropriate length to extend between two or more shoring posts 20) may be used for the beam 40 and the width between the side walls 144 may be just wider than the width of a 2×4 (typically 1.5 or 1.75 inches). The fixed jaw 142 may have a center wall 146 that supports the side walls 144, and in some embodiments the center wall 146 is positioned such that the end portion 42 of the beam rests upon the center wall 146.

The movable jaw 162 may include two opposite side walls 164 that in some embodiments extend outside of the outer surface of the side walls 144 of the fixed jaw 142, while in other embodiments the side walls 164 may extend inboard of the side walls 144 of the fixed jaw 142. The side walls 164 may include apertures that are aligned with corresponding apertures on the side walls 144 to receive a pin 174 to allow for relative rotation of the movable jaw 162 with respect to the fixed jaw 142.

In some embodiments, the movable jaw 162 is biased toward a closed position (FIG. 8) with a spring 172. The spring 172 may be a coil spring and may be wrapped around the pin 174 that connects the fixed and movable jaws 142, 162. The spring 172 is provided to bias the movable jaw toward the closed position such that the movable jaw is biased to bear against a surface (such as the top surface) of the beam 40 when the end portion 42 of the beam extends between the jaws 142, 162. The jaw assembly 140 is configured such that the closed position (FIG. 8) forms a smaller opening 150 than the size of the beam 40, such that the jaws are biased to engage at least the upper and lower surfaces of the end 42 of the beam 40 when disposed therein. When the beam 40 extends between the jaws 142, 162, the opening (at the smallest point, i.e. where the jaws engage the beam) is the same distance as the height of the beam 40.

In some embodiments, the movable jaw 162 may have one or more teeth 264 or one or more sets of teeth 264, which are configured to engage a surface of the beam 40 disposed therein. In other embodiments, the fixed jaw 142 may additionally or alternatively have one or more teeth or rows of teeth.

Figure 11:
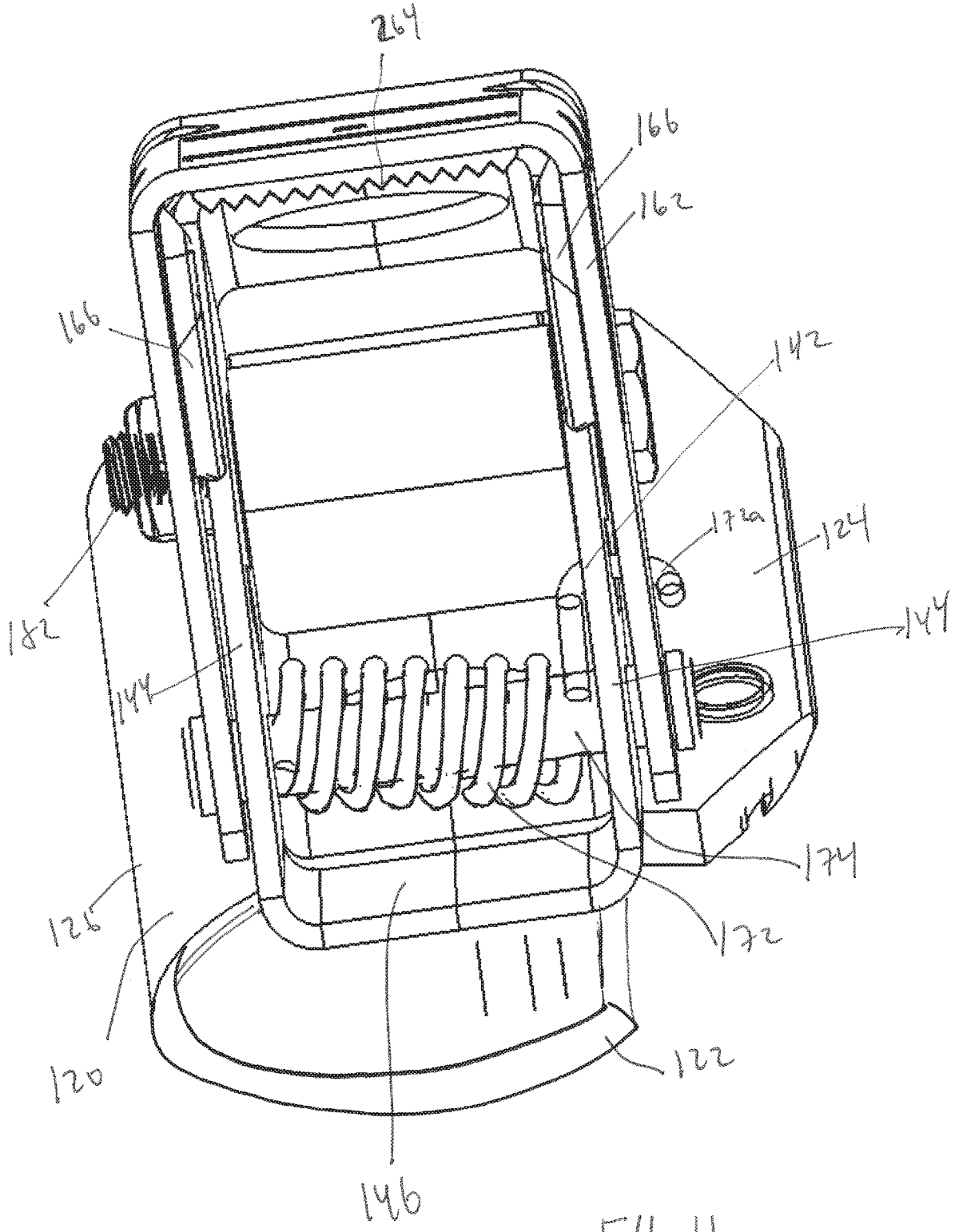
FIG. 11 is a view perspective view of the jaws assembly in the open position.

As shown in FIG. 11, the side walls 164 of the movable jaw 162 may include spacers 166, which are formations that extend inwardly from the side walls to provide for alignment of the end portion 42 of the beam 40 when inserted between the jaws 142, 162. The spacers 166 are configured to be spaced apart the same width as the distance between the side walls 144 of the fixed jaw, such that the spacers 166 engage the beam at a different location than the side walls 144 of the fixed jaw 142 engage the beam. In embodiments where the side walls 164 of the movable jaw 162 are disposed inboard of the side walls 144 of the fixed jaw, the spacers may be provided upon the side walls 144 of the fixed jaw.

In some embodiments, one or both of the jaws 142, 162 may include apertures (aperture 169 depicted in FIG. 5) to allow for fasteners 190, such as nails, to be passed through the respective jaw to provide for additional fixation between the jaws and the end portion 42 of the beam 40.

With reference to FIGS. 5, 8, 9, and 10, the system can be assembled and operated as recited herebelow. Initially, two, three, or more vertical shoring posts are erected, normally based upon an engineered shoring plan. For plans that stipulate that cross-members or braces be provided between neighboring shoring posts, the extended end 42 of a beam 40 is inserted into the jaw assembly 140, and specifically, the movable and fixed jaws are rotated away from each other (in some embodiments against the biasing force of the spring 172) to enlarge the space 150 therebetween to allow the end 42 of the beam 40 to slide between the fixed and movable jaws 142, 162. Once the extended end 42 is inserted within the jaw assembly 140, the jaws are released and they rotate with respect to each other to engage the top and bottom surfaces of the beam, such that the engagement with the jaws retains the beam therewithin. In embodiments where the jaws include teeth 264, the teeth may dig into the beam (in embodiments such as where the beam 40 is a conventional 2×4 of other conventional lumber). The jaw assembly 140 may be configured with features to ensure stable and proper alignment of the beam within the jaw assembly 140.

Next, the beam 40 is engaged with a portion of a first shoring post 20 (shoring post 20*a* in FIG. 1). As best understood with reference to FIG. 5, the user holds a portion of the beam 40 that extends from the jaws assembly 140 to guide the head 120 (pivotably connected to the jaws assembly 140) with the head 120 aligned with the opening between the arms 122, 124 that defines the void horizontally aligned and facing the portion of the shoring post 20 that will mate with the head 120. The user then manipulates the beam 40 so that head moves horizontally (or substantially horizontally) in the direction Z (FIG. 5) toward the shoring post 20. With sufficient movement of the head 120, the first and second arms 122, 124 reach the shoring post 20 such that the shoring post moves within the void 129 between the first and second arms. In embodiments where one or both of the arms has a spring 139, with continued horizontal movement, the shoring post 20 slides past and compresses the spring 139 and then slides further within the void until the spring 139 is partially or fully released from the shoring post. The head 120 is continued to move in direction Z until the shoring post contacts the inner surface of the first and second arms 122, 124 and central portion 126 (when provided) and prevents further motion of the head 12 in the direction Z. Normally the head 120 rests upon a flat plate 26 that is part of the shoring post 20 to support the head 120 (and beam 40) upon the shoring post 20.

The beam 40 is then manipulated to run the beam past the second shoring post 20 (20*b* in FIG. 1) that is adjacent to the first shoring post 20*a*. In some embodiments, the beam 40 is fixed to the second shoring post 20*b* with a clamp, such as a wedge clamp 30 as depicted in the figures. In some other embodiments where an opposite end of the beam will be fixed to the second shoring post, 20*b*, the opposite end of the beam may be fixed to a second jaws assembly 140 and head 120, which is then attached to the second shoring post using the method discussed above.

In embodiments where the beam 40 will be fixed to third (and additional) shoring posts, the beam 40 is moved into engagement with the third shoring post (20*c* in FIG. 1) and fixed thereto either with a clamp, or another jaw assembly 140 and head as discussed above.

As best understood with reference to FIGS. 9-10, the beam 40 extends from the first shoring post 20*a* such that a centerline 40*z* through the beam 40 extends through the first shoring post 20*a*. Because the beam 40 extends past the outer surface of the second shoring post 20*b*, the engagement between the head 120 and the first shoring post 20*a* delivers a force to or from the head 120 (depending upon whether the beam is in tension or compression due to the engineered shoring plan) in a line that is perpendicular or substantially perpendicular to the centerline 40*z* of the beam extending within the jaw assembly 140 (schematically as line 120*z* on FIG. 10). In some embodiments this force is applied along a line that parallel or substantially parallel to a longitudinal axis 122*z* through a portion of the first arm 122 and/or a longitudinal axis through a portion of the second arm 124*z*.

In some embodiments, the alignment of the beam 40 between the jaw assembly 140 connected to the first shoring post 20*a* and past the outer surface of the second shoring post 20*b* necessitates that the beam 40 be bent, as shown in FIG. X with reference to a line 40*z* through the longitudinal axis of the end portion 42 of the beam not extending through the beam 40, let alone the center of the beam 40 as the beam passes by the second shoring post 20*b*. This bending of the beam 40 biases the beam 40 to transfer a force from the end portion 40*a*, through the jaw assembly 140 and to the head 120, which passes to the first shoring post 20*a*. This force causes the head 120 to be securely mounted to the first shoring post 20*a* and maintains the structural stability of the engineered shoring system as discussed above.

Figure 5:
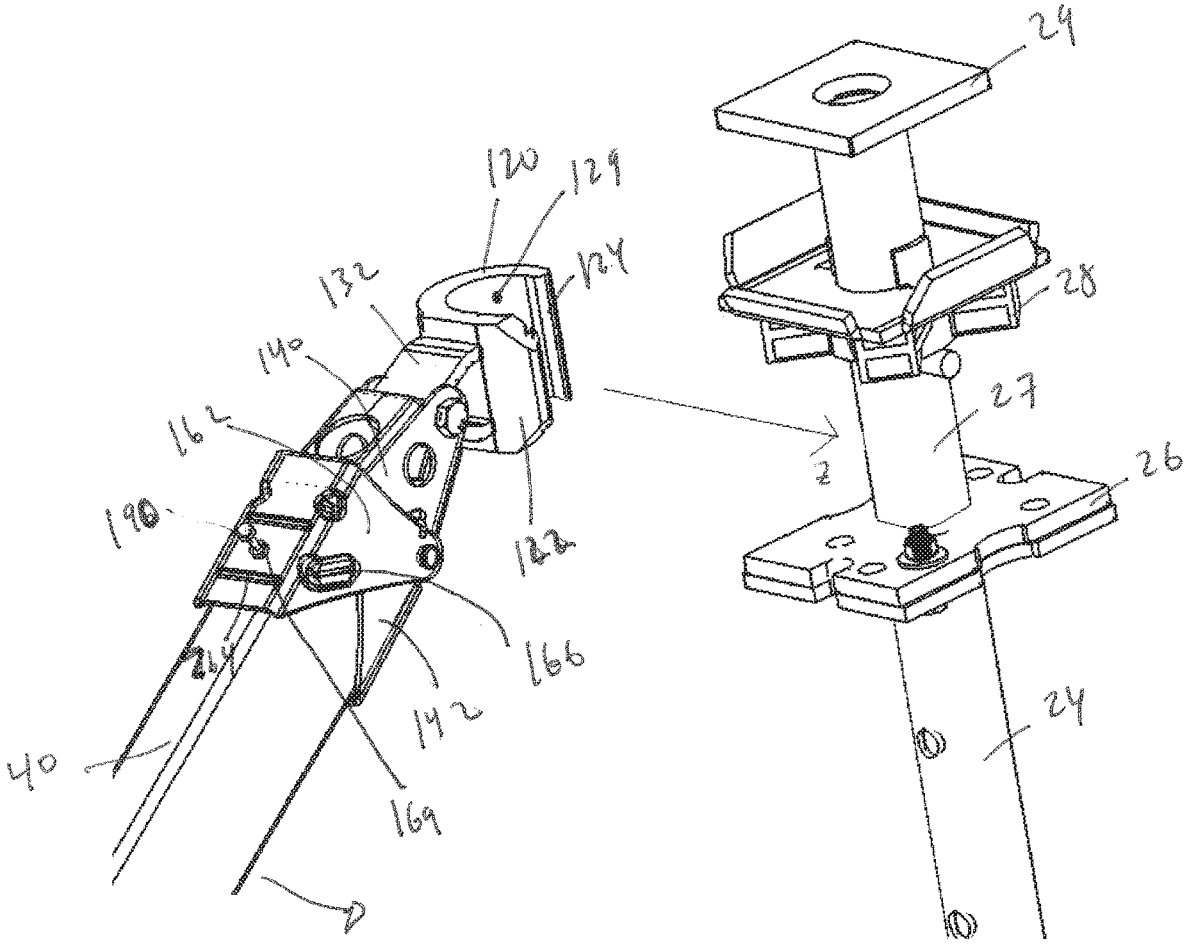
FIG. 5 is a view depicting the head of the connection device of FIG. 1 approaching the shoring post to engage the head with the shoring post.

The system may be disassembled by removing the connection between the beams and the second/third shoring posts 20*b*, 20*c*, such as by removing the clamps that fix those components together. Once the beam is free of the second, third, etc. shoring posts, the user manipulates the beam 40 to force the head 120 to translate away from the first shoring post 20*a* in the horizontal direction opposite to direction Z (FIG. 5). This force urges relative motion between the head 120 and the fixed shoring post, which slides the shoring post 20*a* out of the void 129. In embodiments where a spring 139 is provided upon one or both arms 122, 124, the force applied to the beam to move the head 120 must be sufficient to compress the spring 139 so that the shoring post can urge the spring to a compressed configuration and slide therepast.

Once the head 120 is slid free from the shoring post 20, the end 42 may be removed from the jaws assembly by rotating the movable jaw 162 away from engagement with the beam 40 (and removing any fasteners 190 from the beam 40 through the jaws. The system can then be reassembled in the future to prepare a new engineered shoring plan. In other embodiments, the head 120 may be maintained in connection with the beam 40 for future use.

While the preferred embodiments of the disclosed have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

The invention claimed is:

1. A system for laterally supporting a vertical shoring post, comprising:

a head and a jaw assembly, the jaw assembly movably mounted to the head, the head configured for selective engagement with a shoring post, and the jaw assembly configured for engagement with a beam that provides lateral support to the shoring post;

the head comprising first and second arms that extend in a same general direction and when engaging the shoring post the first and second arms are disposed upon opposite sides of the shoring post, the jaw assembly includes a fixed jaw and a movable jaw, the fixed jaw pivotably connected to the head and the movable jaw pivotably connected to the fixed jaw, wherein the fixed jaw and the movable jaw are configured to receive an end of the beam therebetween; and wherein when the head engages the shoring post, the jaw assembly is configured to align an end of a beam disposed between the fixed and movable jaws of the jaw assembly such that a centerline through the beam extends through a centerline of the shoring post.

2. The system of claim 1, wherein the first and second arms of the head are rigidly connected to each other.

3. The system of claim 1, wherein the first and second arms are monolithically formed with each other.

4. The system of claim 1, further comprising a spring disposed on the first arm proximal to an extended end portion of the first arm, the spring extending toward the second arm, wherein when the head engages the shoring post, the spring is disposed outside of the shoring post.

5. The system of claim 4, wherein the spring is configured to be compressible toward an inner surface of the first arm as the spring slides along the shoring post in a direction to engage the head with the shoring post or in an opposite direction to disengage the head from the shoring post.

6. The system of claim 1, wherein the first and second arms of the head define an open volume therebetween, wherein the first and second arms each include an extended end and wherein a distance between inner surfaces of the first and second arms at the extended ends thereof is greater than a diameter of the shoring post configured to be disposed within the open volume.

7. The system of claim 6, wherein the head further comprises a central portion disposed between the first and second arms, with second ends of the first and second arms intersecting the central portion of the head, wherein the second ends of the first and second arms are opposite the extended ends of the first and second arms, wherein the second ends of the first and second arms and the central portion are disposed with a combined inner surface with a round curvature, with a diameter just slightly larger than the diameter of the shoring post configured to be disposed within the open volume.

8. The system of claim 1, wherein the head is capable of engaging and disengaging a shoring post while the jaw assembly continuously receives an end of a beam therein.

9. The system of claim 8, the head and the jaw assembly are configured such that when a beam is disposed between the movable and fixed jaws of the jaw assembly a user can manipulate the beam to urge the head to approach an exposed portion of a vertical shoring post, such that the first and second arms of the head extend along opposite sides of the shoring post.

10. The system of claim 1, wherein the movable jaw is disposed outboard of the fixed jaw, wherein the movable jaw includes one or more inwardly extending alignment features to engage one or more side surfaces of the beam disposed between the movable jaw and the fixed jaw.

11. The system of claim 1, wherein the movable jaw is urged toward the fixed jaw due to a biasing force of a spring.

12. The system of claim 1, wherein one or both of the movable jaw and the fixed jaw include teeth that are configured to engage a surface of the beam disposed between the movable and fixed jaws of the jaw assembly.

13. The system of claim 12, wherein the movable jaw is urged toward the fixed jaw due to a biasing force of a spring, wherein the biasing force of the spring urges the teeth to engage the surface of the beam.

14. A system for laterally supporting a vertical shoring post, comprising:

a head and a jaw assembly, the jaw assembly movably mounted to the head, the head configured for selective engagement with a shoring post, and the jaw assembly configured for engagement with a beam that provides lateral support to the shoring post;

the head comprising first and second arms that extend in a same general direction and when engaging the shoring post the first and second arms are disposed upon opposite sides of the shoring post, the jaw assembly includes a fixed jaw and a movable jaw, the fixed jaw pivotably connected to the head and the movable jaw pivotably connected to the fixed jaw, wherein the fixed jaw and the movable jaw are configured to receive an end of the beam therebetween;

wherein the head is capable of engaging and disengaging a shoring post while the jaw assembly continuously receives an end of a beam therein;

wherein the head and the jaw assembly are configured such that when a beam is disposed between the movable and fixed jaws of the jaw assembly a user can manipulate the beam to urge the head to approach an exposed portion of a vertical shoring post, such that the first and second arms of the head extend along opposite sides of the shoring post; and wherein the beam extends from the shoring post such that a line through a center of the beam at an end portion within the jaw assembly extends through the shoring post, wherein the beam is configured to be fixed to an outer surface of one or more shoring posts that are adjacent and spaced to the shoring post that engages the head.

15. A system for laterally supporting a vertical shoring post, comprising:

a head and a jaw assembly, the jaw assembly pivotably mounted to the head, the head configured for selective engagement with a shoring post, and the jaw assembly configured for engagement with a beam that provides lateral support to the shoring post;

the head comprising first and second arms that extend in a same general direction and define a void having a first axis there between; said arms being configured to accept a shoring post within said void such that the first and second arms are disposed upon opposite sides of the shoring post, the jaw assembly includes a fixed jaw and a movable jaw, the fixed jaw pivotably connected to the head in a first plane which includes said first axis via a first pivot pin and the movable jaw pivotably connected to the fixed jaw in said first plane via a second pivot pin, wherein the fixed jaw and the movable jaw define a socket configured to receive an end face of the beam therein such that the jaw assembly and the beam are configured to move within said first plane.

* * * * *